United States Patent [19]

Horton et al.

[11] Patent Number: 4,599,991

[45] Date of Patent: Jul. 15, 1986

[54] DOOR FOR BREW KETTLE

[75] Inventors: James P. Horton; Jerry F. Cebe, both of Albany; Dave Hagemes, Leesburg; Lewis M. Jeter, Albany, all of Ga.

[73] Assignee: Miller Brewing Company, Milwaukee, Wis.

[21] Appl. No.: 782,884

[22] Filed: Oct. 2, 1985

[51] Int. Cl.[4] ..... F24H 1/18

[52] U.S. Cl. ..... 126/345; 220/203; 220/206; 99/278; 137/520; 137/521

[58] Field of Search ..... 126/345, 346, 348, 369; 220/203, 206, 251; 137/519, 520, 521; 99/278, 277; 49/70

[56] References Cited

U.S. PATENT DOCUMENTS

| | | | |
|---|---|---|---|
| 203,817 | 5/1878 | Brock | 220/335 |
| 426,628 | 4/1890 | Smith | 137/520 |
| 1,024,059 | 4/1912 | Brintnall | 49/33 |
| 1,393,847 | 10/1921 | Stirling | 220/35 |
| 1,447,102 | 2/1923 | Rae | 137/521 X |
| 1,736,784 | 11/1929 | Gloekler | 16/81 |
| 2,835,269 | 5/1958 | Seymour | 137/467 |

*Primary Examiner*—Randall L. Green
*Attorney, Agent, or Firm*—Quarles & Brady

[57] ABSTRACT

A brew kettle in which the upper portion of the kettle wall includes a manhole and a vent hole and in which a door is pivotally mounted inside the upper wall portion such that, in its closed position, it closes off the manhole. The door is normally open due to the force of its own weight, and a counterweight arm is mounted on the door and extends inside the kettle so as to substantially reduce the force necessary to close the door.

9 Claims, 6 Drawing Figures

FIG. 2
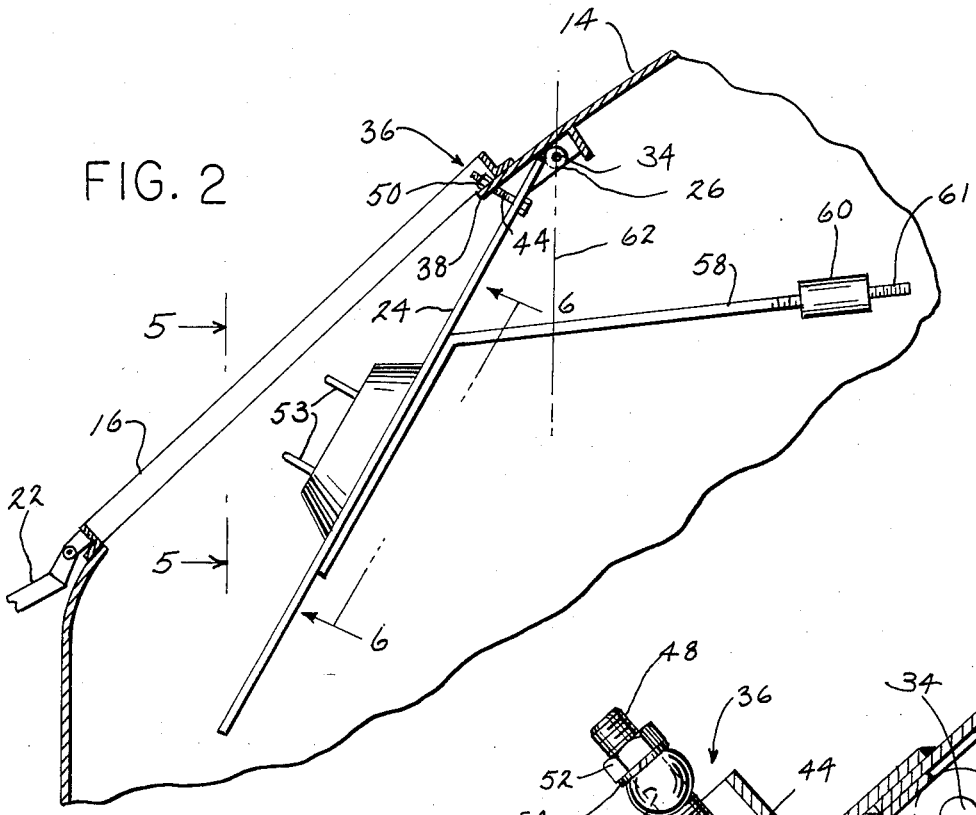
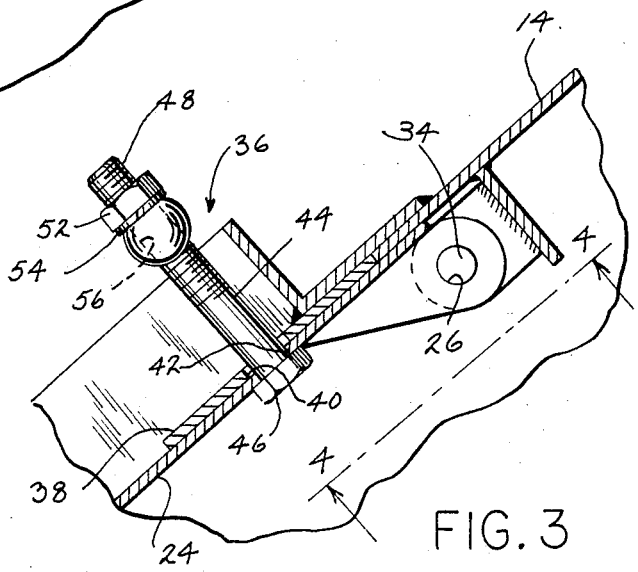
FIG. 3
FIG. 4
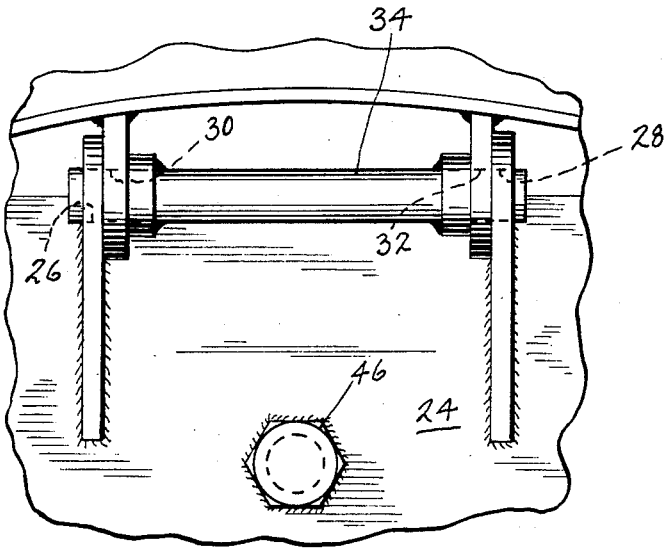
FIG. 6
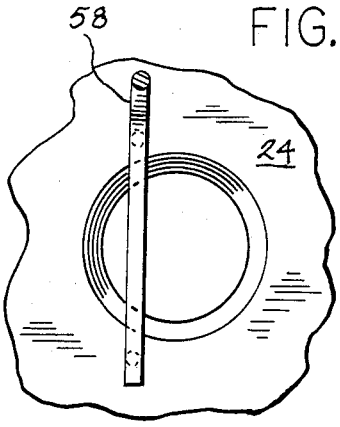

DOOR FOR BREW KETTLE

BACKGROUND OF THE INVENTION

This invention relates to a brew kettle and, in particular, to a door for covering the manhole of a brew kettle.

SUMMARY OF THE INVENTION

The present invention provides a door which will automatically close to cover the manhole when the liquid in the brew kettle begins to boil out the manhole. The door is pivotally mounted inside the wall of the brew kettle, and, due to the force of gravity, is normally open. In its closed position, the door closes the manhole. The door includes a counterweight arm which extends into the brew kettle so as to substantially reduce the force necessary to close the door. When the boiling liquid begins to push against the door, the force of that liquid causes the door to close and to remain closed until the liquid level subsides, thereby permitting the door to open again.

BRIEF DESCRIPTION OF THE DRAWINGS

FIG. 2 is an enlarged, broken away view of the manhole portion of FIG. 1, with the spray nozzles removed.

FIG. 3 is an enlarged, broken away view of the hinge portion of FIG. 2, with the door in the closed position.

FIG. 4 is a view of the hinge area taken along the section 4—4 of FIG. 3.

FIG. 6 is a broken away view of the inside of the door taken along the section 6—6 of FIG. 2.

DESCRIPTION OF THE PREFERRED EMBODIMENT

Figure 1:
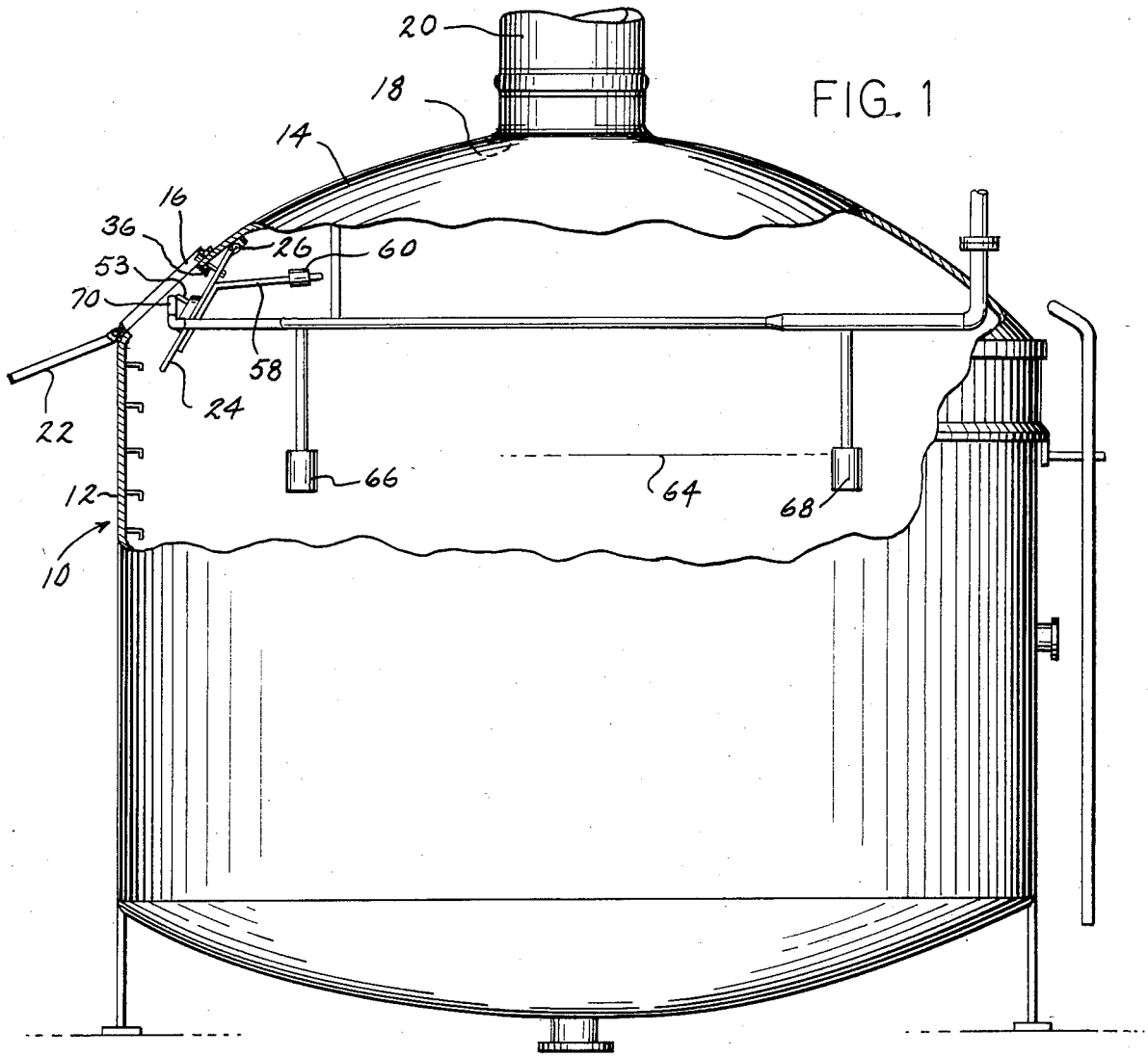
FIG. 1 is a front view partially in section of a brew kettle made in accordance with the present invention.
Figure 5:
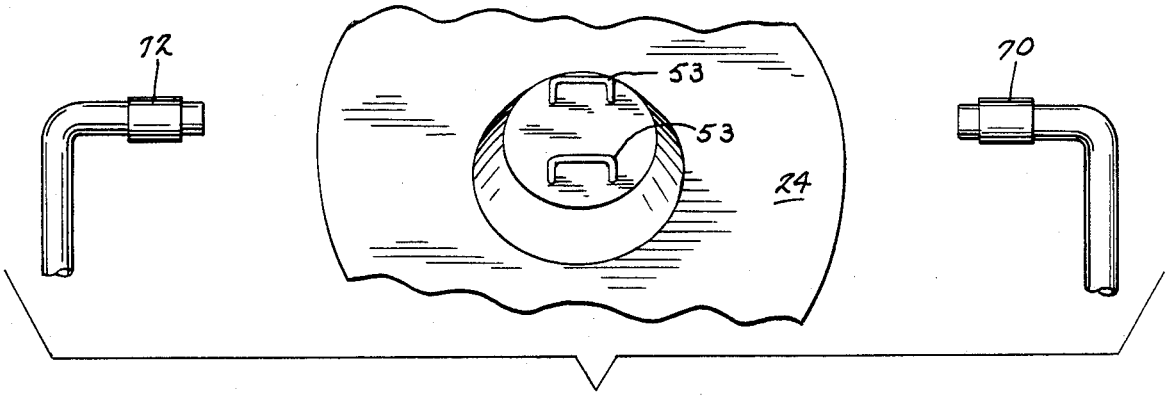
FIG. 5 is a broken away view taken along the section 5—5 of FIG. 2.

The brew kettle 10 is an enclosed vessel made up of a kettle wall 12 which includes an upper wall portion 14. In the upper wall portion 14 are located a manhole 16 and a vent hole 18. The vent hole 18 is connected to a stack 20, and a fan (not shown) is located in the stack area and pulls air in through the manhole 16, out the vent hole 18, and then out the stack 20. A manhole cover 22 is pivotally mounted on the outside of the upper wall 14 opposite the manhole 16 and is normally left open to permit the flow of air through the manhole 16.

A door 24 is pivotally mounted inside the upper wall portion 14 opposite the manhole 16. Due to the force of gravity, the door 24 is normally open. In the closed position, the door 24 closes the manhole 16 from the inside. The door 24 includes hinge eyes 26, 28 which are aligned with hinge eyes 30, 32 mounted on the upper wall portion 14, and a hinge pin 34 is installed through the hinge eyes 26, 28, 30, 32 so that the door 24 is pivotally mounted inside the upper wall portion 14.

A stop assembly 36 is mounted on the door 24 and on the upper wall portion 14 in order to prevent the door 24 from swinging inward as far as it normally would due to the force of gravity and due to the force of the air which is flowing in through the manhole 16 and out the vent 18. The stop assembly 36 stops the door 24 before it reaches a vertical position. If the door 24 were permitted to reach a vertical position or slightly beyond a vertical position, the rising liquid would tend to open the door further instead of closing it as intended by the present invention. During normal operation, the door 24 must be open wide enough to permit the free flow of air through the manhole 16 and out the stack 20.

The stop assembly 36 includes an extension plate 38 which is welded in place and extends into the manhole area 16. The plate 38 includes a hole 40 which is aligned with a hole 42 in the door 24. A bolt 44 extends through the aligned holes 40, 42 with the head 46 of the bolt located inside the door 24. The threaded end 48 of the bolt 44 has a stop 50 mounted on it by means of a nut 52 and lock washer 54. The stop 50 is made from a piece of rod which is flattened on the side adjacent the lock washer 54 and which has a hole 56 through it for installing it on the bolt 44. When the door 24 opens, the stop 50 contacts the plate 38, as shown in FIG. 2, thereby preventing the door 24 from opening further. The location of the stop 50 may be adjusted by moving the nut 52 in or out of the threaded end 48 of the bolt 44. The door also has two handles 53 mounted on its outer surface.

A counterweight arm 58 is bolted on the inside of the door 24 and includes a counterweight 60 which extends inside the brew kettle 10. An imaginary vertical plane 62 is shown in phantom through the axis of the pin 34 (the pivot axis) in FIG. 2. The counterweight 60 is located on the opposite side of the vertical plane 62 from the door 24 at all the operating positions of the door 24. The counterweight 60 carries a threaded rod 61 at its end for receiving additional small weights so that the amount of weight may be adjusted after installation of the door 24 on the kettle 10.

The distance of the weight 60 from the plane 62 and the weight of the counterweight 60 provide a moment which is sufficient to substantially reduce the force necessary for closing the door 24. Therefore, when the liquid in the brew kettle 10 begins to boil violently, extends above the normal liquid level 64, and begins to press against the door 24, the force of the rising liquid is sufficient to cause the door 24 to close. The force of the liquid will then cause the door 24 to remain closed until the boiling action is brought under control and the liquid level returns to normal. When the liquid level subsides, the weight of the door 24 and the pressure caused by the vent fan cause the door 24 to open again for normal operation of the brew kettle.

The kettle 10 also includes a nozzle system for cleaning the kettle 10. There are two large nozzles 66, 68 located in the central area of the kettle 10 and two smaller nozzles 70, 72 located above the door 24 so as to reach the outer surface of the door 24 and the inner surface of the manhole cover 22. In order to clean the kettle 10, the manhole cover 22 is closed and then a cleaning fluid is sprayed through the nozzles 66, 68, 70, 72 in order to reach all interior surface of the brew kettle 10.

It will be obvious to those skilled in the art that modifications may be made to the embodiment described above without departing from the scope of the present invention.

What is claimed is:

1. A brew kettle, comprising:

a kettle wall, which defines an enclosed vessel and includes an upper wall portion, defining a manhole and a vent hole;

a door mounted inside said upper wall portion so as to pivot about a pivot axis, said door being normally open due to the force of its own weight, and mounted such that, when said door is closed, it closes off said manhole, and, when said door is open, it is stopped before it reaches a vertical position; and a counterweight arm mounted on said door and extending into said brew kettle so as to substantially reduce the force necessary to close said door.

2. A brew kettle as recited in claim 1, and further comprising a stop assembly mounted on said kettle for limiting the distance which said door can swing into said kettle.

3. A brew kettle as recited in claim 2, wherein said stop assembly stops said door before it reaches a vertical position.

4. A brew kettle as recited in claim 3, and further including a counterweight mounted on said counterweight arm, said counterweight being located inward from an imaginary vertical plane through said pivot axis at all the operating positions of said door.

5. A brew kettle as recited in claim 4, and further comprising a manhole cover pivotally mounted on the outside of said kettle wall such that, when it is closed, it closes off said manhole.

6. A brew kettle as recited in claim 5, wherein said counterweight arm carries a threaded rod at its end for receiving additional small counterweights to balance said door after installation of said door on said kettle.

7. A brew kettle as recited in claim 6, and further comprising a piping arrangement inside said kettle including nozzles for spraying cleaning solution on the inside of said kettle, wherein said piping arrangement includes a nozzle adapted to spray cleaning solution on the outer surface of said door and on the inner surface of said manhole cover when said manhole cover is closed and said door is open.

8. A brew kettle as recited in claim 7, wherein said stop mechanism includes a plate mounted on said upper wall portion and projecting into said manhole and defining a bolt hole; a bolt fixed on said door and extending outward through said bolt hole; and a stop mounted on the end of said bolt such that, when said door opens, said bolt slides in said bolt hole until said stop reaches said plate, thereby restraining said door from further inward motion.

9. A brew kettle as recited in claim 8, and further including hinge eyes mounted on said door and on said upper wall and a hinge pin mounted through said hinge eyes, the axis of said pin defining said pivot axis.

* * * * *